US008627701B1

(12) United States Patent
Gatchell

(10) Patent No.: US 8,627,701 B1
(45) Date of Patent: Jan. 14, 2014

(54) DEVICE FOR BENDING SHEET MATERIAL

(76) Inventor: Robert W. Gatchell, Oak Bluffs, MA (US)

( * ) Notice: Subject to any disclaimer, the term of this patent is extended or adjusted under 35 U.S.C. 154(b) by 0 days.

(21) Appl. No.: 13/599,787

(22) Filed: Aug. 30, 2012

(51) Int. Cl.
*B21D 5/04* (2006.01)

(52) U.S. Cl.
USPC ..... 72/319; 72/310; 72/320; 72/322; 72/388; 72/461

(58) Field of Classification Search
USPC ..... 72/296, 310, 319, 320, 321, 322, 388, 72/461; 225/96.5
See application file for complete search history.

(56) References Cited

U.S. PATENT DOCUMENTS 143,558 A 10/1873 Brand
155,060 A * 9/1874 Bacon ..... 72/319
2,166,347 A * 7/1939 Farney ..... 72/458
2,905,224 A * 9/1959 Allison ..... 72/31.12
3,161,223 A 12/1964 Marsh
3,248,921 A 5/1966 Trout
3,817,075 A 6/1974 Marsh et al.
3,877,279 A 4/1975 Van Cleave
4,142,395 A * 3/1979 Kelm ..... 72/319
6,925,846 B2 8/2005 Perruccio
8,028,560 B2 10/2011 Badiali
8,191,394 B2 6/2012 Marshall

* cited by examiner

*Primary Examiner* — David B Jones
(74) *Attorney, Agent, or Firm* — Young & Thompson

(57) ABSTRACT

A device for bending sheet material comprises a receiving plate and a forming plate defining or connectable to one another so as to define therebetween a receiving slot of fixed dimensions. A bending plate is pivotally connected to the receiving plate. The bending plate has an upper surface substantially in a common plane with an upper surface of the receiving plate. The forming plate comprises a first side surface extending along an open end of the receiving slot and forming a first acute angle with a first major surface of the forming plate. The bending plate has a range of pivotal motion of greater than 90°.

20 Claims, 5 Drawing Sheets

DEVICE FOR BENDING SHEET MATERIAL

BACKGROUND OF THE INVENTION

1. Field of the Invention

The invention relates to a device for bending sheet material, and preferably but not exclusively to a portable bender for metal roof flashing.

2. Description of Related Art

Various devices for bending sheet material, including various flashing brakes and benders, are known in the art, for example as described in U.S. Pat. Nos. 143,558; 155,060; 3,161,223; 3,248,921; 3,817,075; 3,877,279; 6,925,846; 8,028,560; and 8,191,394. Such devices normally require that the sheet material be clamped into the device before it can be bent, or do not form a precise and reproducible bend angle in a simple way. U.S. Pat. No. 8,028,560 describes a brake attachment for a pair of locking pliers, whereas the other flashing brakes described in the patents listed above are larger and more complicated, such that although they could be taken to a job site they would be too heavy and/or unwieldy to use while on the roof.

Step flashing is commonly sold pre-cut, with common sizes being 5"×7" and 8" by 7". The flashing tiles are typically bent prior to installation to approximately 90°, to provide a pair of 2½ inch or 4 inch legs. Alternatively, some manufacturers sell step flashing tiles that are pre-bent to approximately 90°, but the cost is typically substantially more than for unbent step flashing tiles. U.S. Pat. No. 8,191,394 describes a machine for imparting an approximately 90° bend to step flashing tiles, but this machine is a relatively large bench-mounted device that would not be practical to use at the point of installation of the tiles (i.e., by a roofer while on the roof of a building).

SUMMARY OF THE INVENTION

The present invention provides a device for bending sheet material that is simple to use, reliable in operation, and which, in preferred embodiments, can be made sufficiently small to be hand held and used in a wide variety of locations where the devices of the prior art could not feasibly be deployed.

The device comprises a receiving plate and a forming plate defining or connectable to one another so as to define therebetween a receiving slot of fixed dimensions, and a bending plate pivotally connected to the receiving plate. The bending plate has an upper surface substantially in a common plane with an upper surface of the receiving plate, and the forming plate comprises a first side surface extending along an open end of the receiving slot. The first side surface forms a first acute angle with a first major surface of the forming plate, and the bending plate has a range of pivotal motion of greater than 90°.

In preferred embodiments of the device according to the present invention, a pair of guide spacers is affixed to or formed integrally with one or both of the receiving plate and the forming plate, the pair of guide spacers defining a height and width of the receiving slot.

In preferred embodiments of the device according to the present invention, the pair of guide spacers is affixed to or formed integrally with the receiving plate.

In preferred embodiments of the device according to the present invention, the forming plate comprises a second side surface on an opposite side of the forming plate from the first side surface, the second side surface forming a second acute angle with a second major surface of the forming plate, the second acute angle being different than the first acute angle.

The forming plate is connectable to the receiving plate in an inverted position such that the second side surface extends along the open end of the receiving slot.

In preferred embodiments of the device according to the present invention, an end plate is affixed to or formed integrally with the receiving plate, the end plate having a surface acting as a stop to limit an extent of insertion of a piece of sheet material into the receiving slot.

In preferred embodiments of the device according to the present invention, the end plate has a stepped profile and is connectable to the receiving plate in two different orientations so as to provide stops having respectively different positions.

In preferred embodiments of the device according to the present invention, a hinge pivotally connects the bending plate to the receiving plate.

In preferred embodiments of the device according to the present invention, the hinge comprises projections formed integrally with the bending plate alternating and interfitting with projections formed integrally with the receiving plate, and a pivot pin passing through the projections.

In preferred embodiments of the device according to the present invention, at least the bending plate and the receiving plate are formed of injection molded plastic.

In preferred embodiments of the device according to the present invention, the forming plate comprises a body formed of injection molded plastic and at least one metal insert constituting a forming edge.

In preferred embodiments of the device according to the present invention, the at least one metal insert is mountable in a reverse position so as to position a second forming edge along the receiving slot.

In preferred embodiments of the device according to the present invention, the first acute angle is in a range from 30°-60°, preferably 40°-50°.

In preferred embodiments of the device according to the present invention, the second acute angle is in a range from 45°-75°, preferably 55°-65°.

In preferred embodiments of the device according to the present invention, the device is less than sixteen inches in its maximum extent.

In preferred embodiments of the device according to the present invention, at least one of the pair of guide spacers is connectable to the receiving plate or the forming plate in at least two different positions, so as to define at least two different widths for the receiving slot.

In preferred embodiments of the device according to the present invention, the end plate is movable relative to the receiving plate between at least two position, so as to define at least two different depths for the receiving slot.

In preferred embodiments of the device according to the present invention, pins are received in bores in the forming plate, the pins acting as a stop to limit an extent of insertion of a piece of sheet material into the receiving slot.

In preferred embodiments of the device according to the present invention, the receiving plate comprises at least two sets of bores for receiving the pins and the pins are removable so as to be positioned in a selected one of the at least two sets of bores.

BRIEF DESCRIPTION OF THE DRAWINGS

Other objects, features and advantages of the invention will become more apparent after reading the following detailed description of preferred embodiments of the invention, given with reference to the accompanying drawings, in which.

DETAILED DESCRIPTION OF PREFERRED EMBODIMENTS

Figure 1:
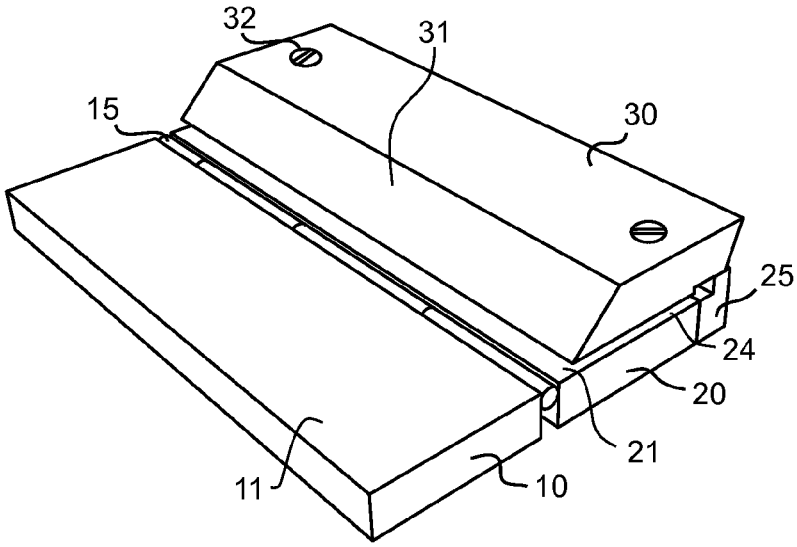
FIG. 1 is a perspective view of a device according to a first embodiment of the present invention.
Figure 2:
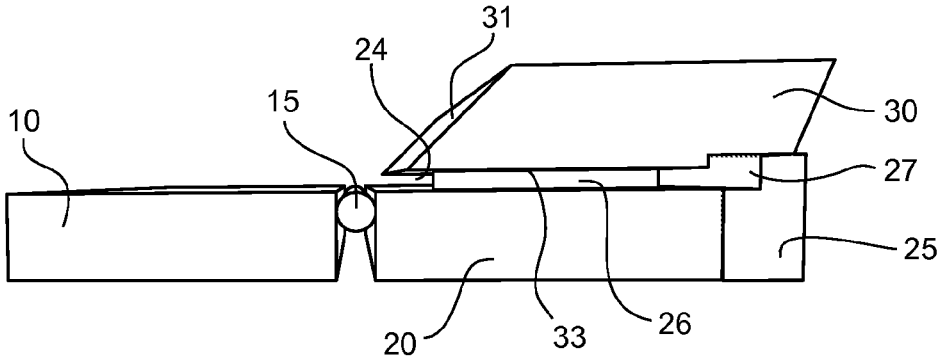
FIG. 2 is a side view of the device of FIG. 1.
Figure 3:
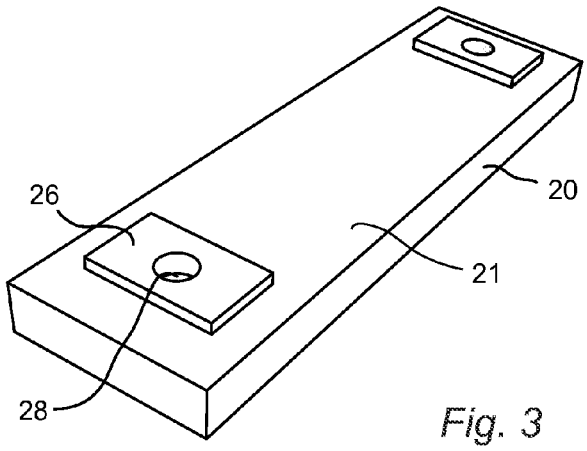
FIG. 3 is a perspective view of the receiving plate of the device of FIG. 1, with a pair of guide spacers mounted thereon.

Referring now to the drawings, the device illustrated in FIGS. 1-3 has three main parts, namely, bending plate 10, receiving plate 20 and forming plate 30. The upper surface 11 of the bending plate 10 lies in approximately the same plane as the upper surface 21 of the receiving plate 20. Bending plate 10 is pivotally connected to receiving plate 20, in this embodiment by a piano hinge 15.

In the device of this embodiment, the forming plate 30 is connected to the receiving plate 20 by bolts 32 such that a fixed gap or slot 24 is defined between these plates. An end plate 25 is connected to the receiving plate 20. The end plate has a surface 27 acting as a stop to limit the extent to which a piece of sheet material can be inserted into the receiving slot. In alternative embodiments, the end plate may be connected to the forming plate 30, or plates 20, 25 and 30 may be formed as a single piece, in which case bolts 32 may be omitted.

In FIGS. 2 and 3, also visible is the pair of guide spacers 26 that are utilized in this embodiment. The height of spacers 26 determines the spacing between the receiving plate 20 and the forming plate 30, and hence the height of the slot 24. The spacing between spacers 26 determines the width of the slot 24, and hence the width of a sheet of material that can be received within the slot 24. Spacers 26 also include bores 28 to receive the bolts 32. Bores 28 may be threaded, or may be continued by underlying threaded bores formed within the receiving plate 30.

As shown in FIG. 2, the forming plate 30 comprises a side surface 31 extending along an open end of the receiving slot 24, which forms an acute angle with the underside surface 33 of forming plate 30 which is in a range from 30°-60°, preferably 40°-50°, most preferably about 45°. Surfaces 31 and 33 need not intersect at a sharp edge, but may be separated slightly from one another for example by a slightly rounded edge. Nevertheless, the separation between surfaces 31 and 33 at the forming edge is preferably less than 5 mm, and more preferably about 3 mm or less.

Figure 4:
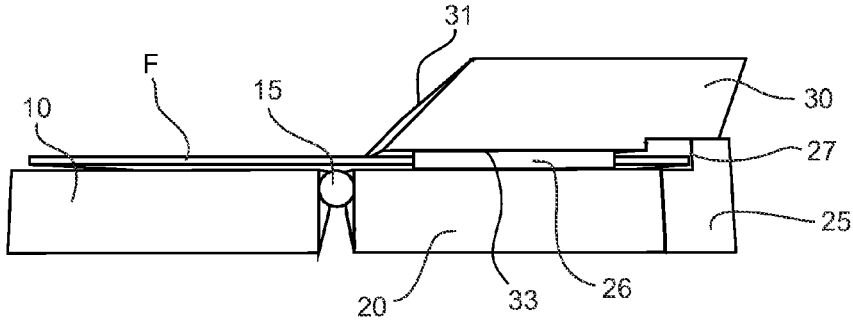
FIG. 4 is a view similar to that of FIG. 2, after an unbent step flashing tile has been inserted into the device.

Turning now to FIG. 4, a sheet of material, which in this embodiment is a 5" by 7" tile of aluminum step flashing F having a thickness of about 0.011", has been inserted into slot 24, between the guide spacers 26, until the leading edge of the tile F abuts against the stop surface 27 of end plate 25. The short dimension of the tile F is in this case parallel to the plane of the drawing, and the long dimension is perpendicular to it, as the tile is to be bent to create a pair of 2.5" legs at right angles to one another. For 8" by 7" flashing tiles, the long dimension would be parallel to the plane of the drawing where a pair of 4" legs is required.

Figure 5:
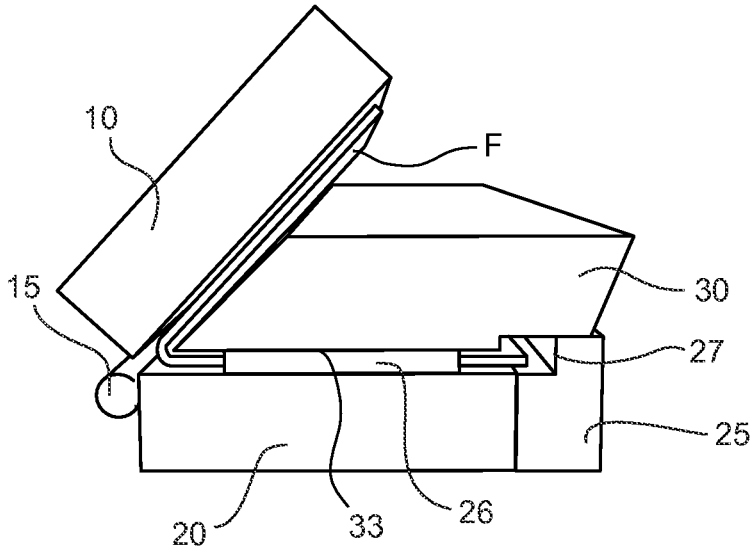
FIG. 5 is the device and tile of FIG. 4 after the bending plate has been pivoted so as to bend the step flashing tile against the forming plate.

Next, as shown in FIG. 5, the user simply pivots the bending plate 10 relative to the receiving plate 20, about hinge 15, so as to force the tile F to be bent along the forming edge of forming plate 30. As can be seen in FIG. 5, the bending plate 10 has a range of pivotal motion of greater than 90°, and the limit of its motion is simply when the tile F is pressed fully against surface 31 of forming plate 31.

In the case of 5×7" aluminum flashing tiles, the present inventor has discovered that the inherent elasticity of the tiles requires that they be bent significantly beyond 90° in order that the tile have a final bend angle of approximately 90°. Thus, after performing the operation illustrated in FIG. 5, the bending plate 10 is flipped back to its starting position (which may be assisted by the elasticity of the tile F), and the tile F will have a final bent configuration of approximately 90°.

It is to be noted that no clamping of the tile F within slot 24 is required by the device according to the invention, thereby eliminating a potentially cumbersome operation required by the flashing brakes of the prior art. Instead, a user need only keep the device level or incline it slightly such that the opening of slot 24 is higher than the bottom of slot 24, to keep the flashing tile F from falling out before it can be bent. This is readily accomplished in devices according to preferred embodiments of the present invention because of the small overall size of the more preferred embodiments. Furthermore, the absence of clamping means that the bend formed in the flashing tiles F will be less drawn than in conventional bending brakes, leading to improved strength and less tendency for corrosion to cause failure at the bend.

Figure 6:
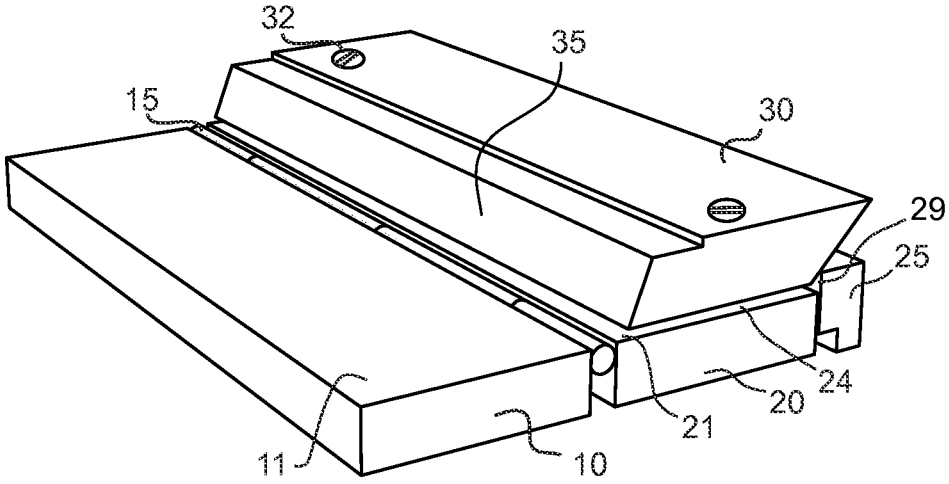
FIG. 6 is a perspective view of the device of FIG. 1 after the forming plate and end plate have been switched to their respective inverted and reversed positions.

FIG. 6 illustrates the same device as in the preceding figures, but which has been converted for bending flashing of copper or tin, by inverting the forming plate 30 and reversing the end plate 25. In particular, a user simply removes bolts 32, turns forming plate 30 upside down, and reattaches the inverted plate 30 with the same bolts 32. Similarly, end plate 25 is reversed by removing its associated bolts (not shown), flipping it to the position shown in FIG. 6, and reattaching it to the receiving plate 20 using the same bolts (not shown).

The configuration of FIG. 6 reveals the inventor's discovery that the properties of flashing tiles made from copper and tin are such that they also need to be bent to an angle greater than 90° in order to have a final bend of about 90°; however, in the case of copper and tin, the intermediate bending angle is not so great as in the case of aluminum. Therefore, the side surface 35 that now extends along the open end of the receiving slot 24, also forms an acute angle with the underside surface (formerly the upper surface) of forming plate 30, which is in a range from 45°-75°, preferably 55°-65°, most preferably about 60°. Once again, these surfaces need not intersect at a sharp edge, but may be separated slightly from one another for example by a slightly rounded edge. Nevertheless, the separation between these surfaces at the forming edge is preferably less than 5 mm, and more preferably about 3 mm or less.

In both configurations of the device of this embodiment, the tile F during a bending operation will be dragged slightly backwardly out of the slot 24, owing to the absence of clamping as well as the offset between the axis of hinge 15 and the edge where the forming surface 31, 35 meets the adjacent underside surface of the forming plate 30. However, in the configuration for copper or tin tiles illustrated in FIG. 6, the lesser extent of intermediate bending means that the tile F will be pulled from the slot to a lesser extent. Consequently, in order to cause the bend to be positioned as closely as possible to the middle of the tile F, the stop surface 29 of end plate 25 is positioned differently in the FIG. 6 configuration than the stop surface 27 in the FIG. 1 configuration.

Figure 7:
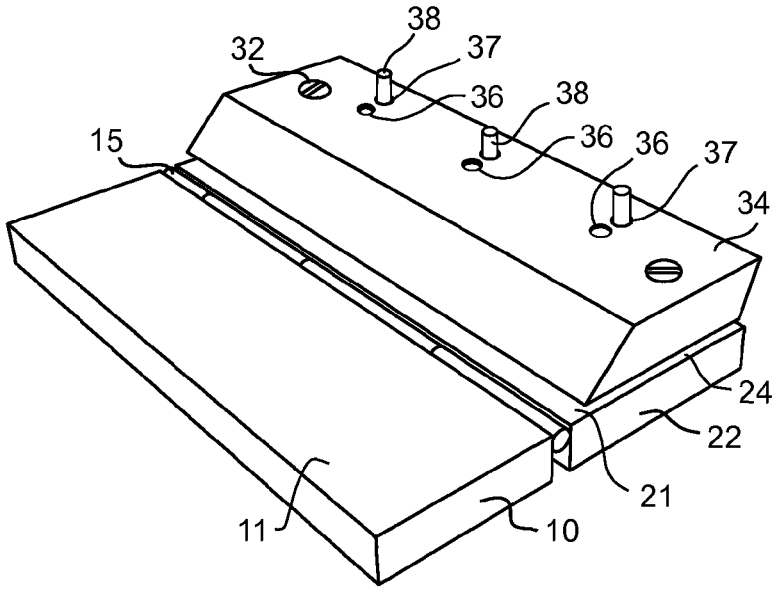
FIG. 7 is a perspective view similar to that of FIG. 1, of a device illustrating a second embodiment.
Figure 8:
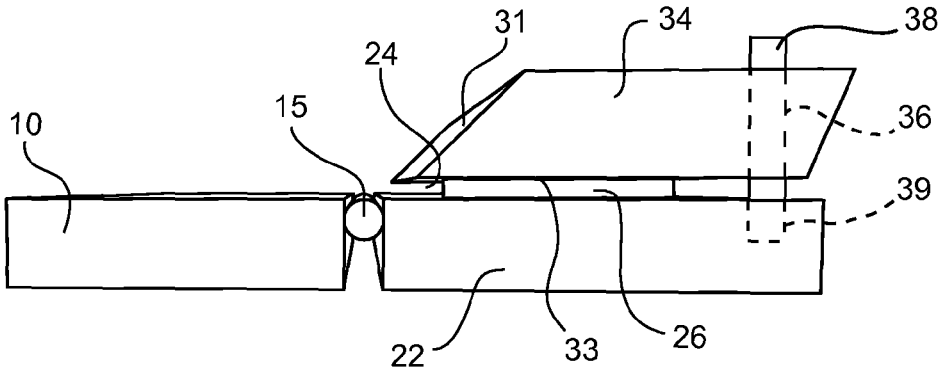
FIG. 8 is a view similar to that of FIG. 2, of the device of FIG. 7.

In FIGS. 7 and 8, a second embodiment is shown in which the end plate of the first embodiment has been eliminated in favor of a set of pins 38 received in a row of bores 36 or 37 that pass through the modified forming plate 34, and are aligned with blind bores 39 formed in the modified receiving plate 22. As can be seen from FIG. 8, the pins 38 thus serve as stops to limit the extent of insertion of a flashing tile F into slot 24, and the plural rows of through bores 36, 37 in forming plate 34 and aligned blind bores 39 in receiving plate 22 allow a user to change the position of the slot depending upon the size and or material of the flashing tile F to be bent.

Figure 9:
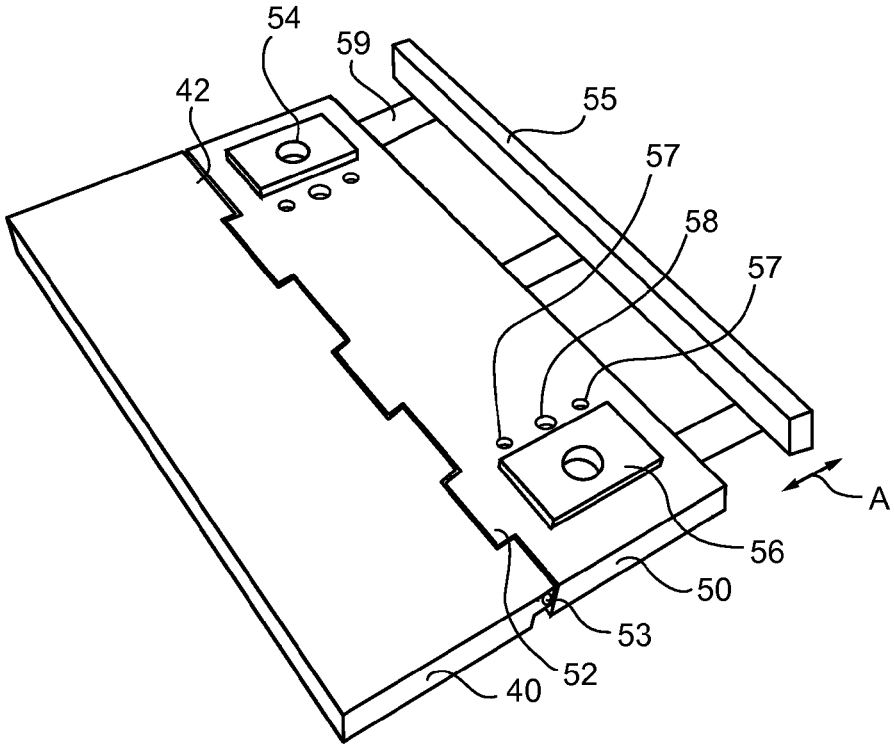
FIG. 9 is a perspective view similar to that of FIG. 1, of a device illustrating various alternative embodiments of the present invention, with the forming plate removed.
Figure 10:
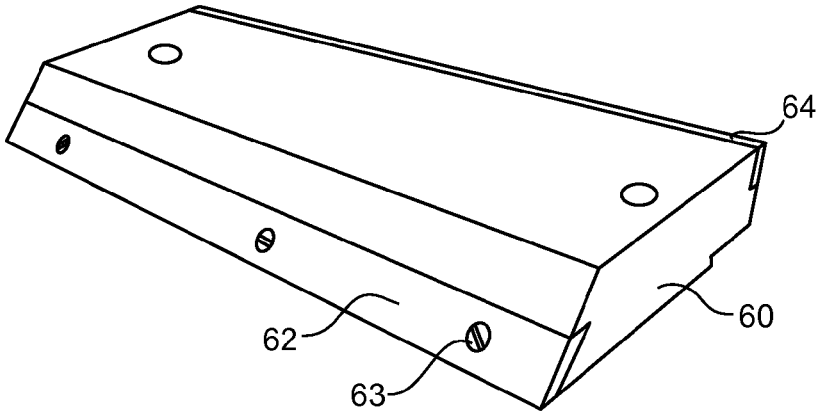
FIG. 10 is a perspective view of a forming plate usable with the device of FIG. 9, and illustrating still further embodiments of the present invention.

In FIGS. 9 and 10, several alternative embodiments are shown that are considered to be advantageous to production of devices according to the present invention on a commercial scale. The characteristics and operation of these embodiments is as described for the preceding embodiments except as otherwise noted.

In FIG. 9, the forming plate has been removed so as to reveal the bending plate 40 and receiving plate 50, which in this embodiment are both formed from injection molded plastic. In order to form these elements with the desired dimensions it may be advantageous to make each of these plates hollow, with the respective plate halves being injection molded and then joined at a seam. Guide spacers 56 are fitted into receiving plate 50 via positioning pins (not shown), and spacers 56 may thereby be manually removed and repositioned in an adjacent set of holes 57, with a metal threaded bore insert 58 being provided in receiving plate 50 to align with the bore 54 in guide spacer 56. Thus, flashing tiles of three different widths can be accommodated by moving one or both of the guide spacers 56 between the two positions illustrated.

Similarly, the end plate 55 of these embodiments is mounted to the receiving plate 50 by three slides 59, which permit the end plate to be moved either continuously or between predetermined positions established by detents or the like, to take account not only of the different bending properties of different materials, but also of different lengths of tiles to be bent.

With plates 40 and 50 being formed of injection molded plastic, it is preferred that the piano hinge 15 of the preceding embodiments be replaced by a hinge formed by integral projections 42, 52 formed in plates 40, 50 respectively, through which a metal pivot pin 53 is threaded.

The forming plate 60 shown in FIG. 10 is usable with the remainder of the device as shown in FIG. 9. In this embodiment, forming plate 60 is made of injection molded plastic, in the same manner described above in connection with plates 40 and 50. However, in this embodiment, metal inserts 62, 64 are fastened to the plastic forming plate 60, with the metal inserts 62, 64 corresponding to the two forming edges of the forming plate 60. From the manner in which metal insert 62 is affixed to the plastic plate 60 with screws 63, it is apparent that each of the inserts 62, 64 provides a reserve edge such that if the forming edge currently in use were to wear out or become damaged, the insert 62 or 64 could be removed, reversed and re-attached so as to position the reserve forming edge in the working position.

It is also within the scope of the present invention to make the forming plate entirely from injection molded plastic, without metal inserts as described above.

In each of the foregoing embodiments, it will be recognized that the devices according to the present invention may be made sufficiently small so as to be readily hand-held, although it is also within the scope of the invention to make the devices of any desired size. In particular, advantageous embodiments of the devices according to the invention have a maximum extent of less than sixteen inches, and more preferably less than twelve inches.

Thus, when the device of the present invention is embodied as a step flashing bender, it may be made sufficiently portable that a roofer can easily take the device with him up on the roof and bend the flashing tiles just prior to installation, which would be impractical or impossible with conventional bending brakes.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. Device for bending sheet material, comprising a receiving plate and a forming plate defining or connectable to one another so as to define therebetween a receiving slot of fixed dimensions, a bending plate pivotally connected to said receiving plate, and a pair of guide spacers positioned on or formed integrally with one or both of the receiving plate and the forming plate, the pair of guide spacers defining a height and width of said receiving slot, the bending plate having an upper surface substantially in a common plane with an upper surface of said receiving plate, wherein said forming plate comprises a first side surface extending along an open end of said receiving slot, said first side surface forming a first acute angle with a first major surface of said forming plate, and wherein said bending plate has a range of pivotal motion of greater than 90°.

2. The device according to claim 1, wherein the pair of guide spacers is affixed to or formed integrally with the receiving plate.

3. The device according to claim 1, further comprising a hinge pivotally connecting said bending plate to said receiving plate.

4. The device according to claim 3, wherein said hinge comprises projections formed integrally with said bending plate alternating and interfitting with projections formed integrally with said receiving plate, and a pivot pin passing through said projections.

5. The device according to claim 1, wherein at least said bending plate and said receiving plate are formed of injection molded plastic.

6. The device according to claim 5, wherein said forming plate comprises a body formed of injection molded plastic and at least one metal insert constituting a forming edge.

7. The device according to claim 6, wherein said at least one metal insert is mountable in a reverse position so as to position a second forming edge along said receiving slot.

8. The device according to claim 1, wherein said device is less than sixteen inches in its maximum extent.

9. The device according to claim 1, wherein at least one of the pair of guide spacers is connectable to the receiving plate or the forming plate in at least two different positions, so as to define at least two different widths for said receiving slot.

10. The device according to claim 1, further comprising pins received in bores in said forming plate, the pins acting as a stop to limit an extent of insertion of a piece of sheet material into said receiving slot.

11. The device according to claim 10, wherein said receiving plate comprises at least two sets of bores for receiving said pins and wherein said pins are removable so as to be positioned in a selected one of said two sets of bores.

12. Device for bending sheet material, comprising a receiving plate and a forming plate defining or connectable to one another so as to define therebetween a receiving slot of fixed dimensions, and a bending plate pivotally connected to said receiving plate, the bending plate having an upper surface substantially in a common plane with an upper surface of said receiving plate, wherein said forming plate comprises a first side surface extending along an open end of said receiving slot, said first side surface forming a first acute angle with a first major surface of said forming plate, wherein said bending plate has a range of pivotal motion of greater than 90°, and wherein said forming plate comprises a second side surface on an opposite side of said forming plate from said first side surface, said second side surface forming a second acute angle with a second major surface of said forming plate, said second acute angle being different than said first acute angle, and wherein said forming plate is connectable to said receiving plate in an inverted position such that said second side surface extends along said open end of said receiving slot.

13. The device according to claim 12, further comprising an end plate affixed to or formed integrally with the receiving plate, the end plate having a surface acting as a stop to limit an extent of insertion of a piece of sheet material into said receiving slot.

14. The device according to claim 13, wherein said end plate has a stepped profile and is connectable to said receiving plate in two different orientations so as to provide stops having respectively different positions.

15. The device according to claim 13, wherein said end plate is movable relative to the receiving plate between at least two position, so as to define at least two different depths for said receiving slot.

16. The device according to claim 12, wherein said first acute angle is in a range from 30°-60°.

17. The device according to claim 16, wherein said first acute angle is in a range from 40°-50°.

18. The device according to claim 12, wherein said second acute angle is in a range from 45°-75°.

19. The device according to claim 18, wherein said second acute angle is in a range from 55°-65°.

20. Device for bending sheet material, comprising a receiving plate and a forming plate defining or connectable to one another so as to define therebetween a receiving slot of fixed dimensions, and a bending plate pivotally connected to said receiving plate, wherein said forming plate comprises a first side surface extending along an open end of said receiving slot, said first side surface forming a first acute angle with a lower surface of said forming plate, and wherein said bending plate has a range of pivotal motion of greater than 90°, from a loading position in which a major surface of said bending plate is substantially in a common plane with an upper surface of said receiving plate, to a final bending position in which said major surface is generally parallel to and projects beyond said first side surface of the forming plate.

* * * * *